United States Patent [19]

Hayashi et al.

[11] Patent Number: 4,697,821

[45] Date of Patent: Oct. 6, 1987

[54] SKI

[75] Inventors: Keijiro Hayashi, Takatsuki; Kenzo Shinya, Gifu; Toshimi Awano, Ohgaki; Shigeru Asai, Gifu, all of Japan

[73] Assignee: Mizuno Corporation, Osaka, Japan

[21] Appl. No.: 576,741

[22] Filed: Feb. 3, 1984

[30] Foreign Application Priority Data

Feb. 4, 1983 [JP] Japan ..... 58-17993

[51] Int. Cl.[4] ..... A63C 5/04

[52] U.S. Cl. ..... 280/609; 280/610

[58] Field of Search ..... 280/609, 610, 601, 602, 280/817

[56] References Cited

U.S. PATENT DOCUMENTS 2,158,325 5/1939 Hunt ..... 280/610

FOREIGN PATENT DOCUMENTS 901914 11/1944 France ..... 210/610
1118884 3/1956 France ..... 280/610
1282053 12/1961 France ..... 280/610
615449 1/1961 Italy ..... 280/610
622973 7/1961 Italy ..... 280/610

*Primary Examiner*—John J. Love
*Assistant Examiner*—Eric Culbreth
*Attorney, Agent, or Firm*—Fleit, Jacobson, Cohn & Price

[57] ABSTRACT

A ski comprises an upper-surface constituting member provided with a projection which is constituted by an upper-surface member and a reinforcing member, and has the shape of a roof whose ridge is defined by the widthwise central portion of the ski. The upper-surface constituting member is formed on the upper part of the ski.

8 Claims, 6 Drawing Figures

SKI

BACKGROUND OF THE INVENTION

The present invention relates to an improvement in skis.

Skis have been made of wood, FRP, fiber reinforced metals and other material.

Wooden skis frequently used in the past were in a keel-like shape and had an intermediate portion which is thickened in order to maintain strength. Since such skis are heavy, bad in maneuverability and insufficient in flexural rigidity, however, they have gradually been replaced with tabular skis, which are made of FRP or metals and excellent in performance. Skis generally used now have such a shape that, as shown in FIG. 1, the thickness of a ski 1 gradually increases from the ski front end portion to the central portion and then gradually decreases from the central portion to the rear end portion. That is, both the front and rear parts are tapered, and the intermediate upper surface of the ski 1 is flat. On the other hand, such structures are known as a sandwich structure in which, as shown in FIG. 2, reinforcing members 2 constituted by FRP plates or the like are disposed on the upper and lower surfaces of a core material or as a box structure in which a reinforcing member is disposed around the entire periphery of a core material.

These structures are generally employed by ski manufacturers, since they facilitate the ski manufacturing process.

In view of the physical properties of skis, however, it is exceedingly difficult to provide a design which gives an optimum balance of various interrelated properties, such as torsional strength, flexural strength, vibration damping property, air resistance and the like.

For example, if the torsional strength of a ski is improved, the flexural strength becomes higher to make the ski unfavorably rigid as well as to impair the vibration damping property, causing adverse effects on the sliding performance.

In addition, for reduction of the air resistance of a ski in sliding, a bore of any desired shape is opened in the shovel portion formed at the front end of a ski, or the rising degree of the shovel portion is decreased, thereby to suppress the air resistance as much as possible for increasing the speed in sliding. These methods, however, require much labor in the manufacturing process and a higher production cost.

Therefore, it has been desired to develop a ski improved to have a proper elasticity, a high torsional strength, an excellent vibration damping property and a small air resistance value through a combination of materials having various properties. Although various research and development work has been carried out, no satisfactory ski has been proposed yet.

In view of the above-mentioned disadvantages of the prior art, it is an object of the invention to provide a ski excellent in slidability through an improvement of the ski in various properties, such as rigidity, torsional strength, vibration damping and, air resistance, by replacing the conventional upper surface shape of the ski, which has been tabular, with such a shape that a roof-shaped projection is formed on the upper surface of the ski.

Figure 1:
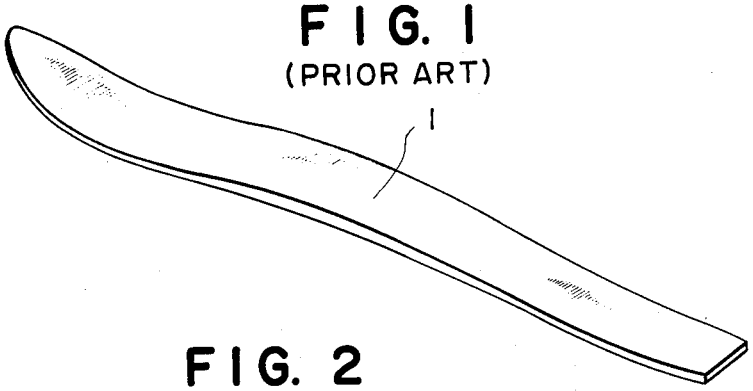
FIG. 1 (PRIOR ART)
FIG. 1 is a perspective view of a conventional ski.
Figure 2:
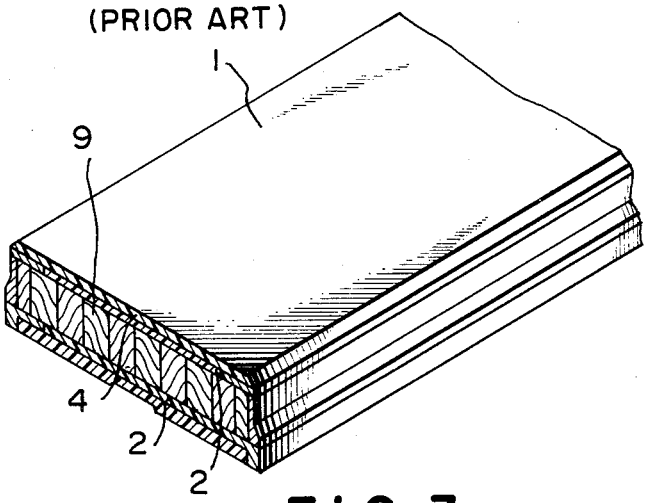
FIG. 2 (PRIOR ART)
FIG. 2 is a sectional perspective view of an essential part of a ski having a conventional sandwich structure.
Figure 3:
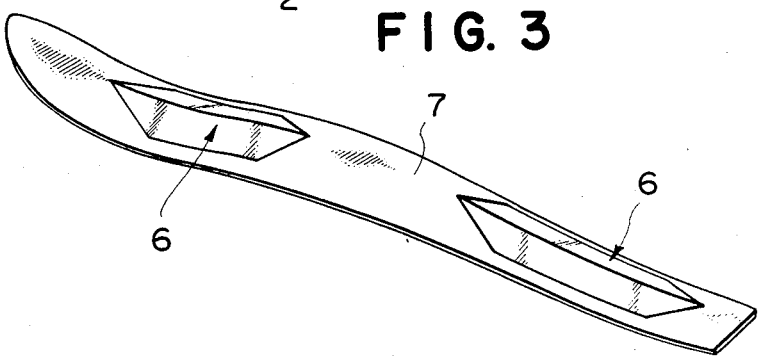
FIG. 3 is a perspective view of an upper-surface constituting member provided with roof-shaped projections in accordance with the invention.

The invention will be described herein with reference to the accompanying drawings. According to the invention, there is provided a ski 3 comprising an uppersurface constituting member 7 provided with a projection 6 which is constituted by an upper-surface member 4, a reinforcing member 5 and has the shape of a roof of any desired shape whose ridge is defined by the widthwise central portion of the ski 3, the projection 6 being formed at any desired position on the upper surface of the ski 3 and extending across a major portion of the width of the ski.

Since the ski of the invention has the roofshaped projection 6 formed on the upper-surface constituting member 7, there are improvements in torsional strength and flexural strength, which the conventional skis are wanting. In consequence, the formation of the roof-shaped projection 6 in front and at the rear of a ski binding mounting region of the upper-surface constituting member 7 or either in front or at the rear thereof makes it possible to design, for example, the ski 3 to be flexible as a whole and the front and rear parts of the ski 3 to be high in torsional strength and flexural strength. Moreover, the employment of a combination of materials, having various properties, for each of the upper-surface member 4 and the reinforcing member 5 permits a further improvement in freedom of design for the ski. It is to be noted that although according to the illustrated embodiment a core material 8 is interposed in the projection 6 in forming the upper-surface constituting member 7 provided with the roof-shaped projection 6, the projection 6 may be hollow, without any core material 8 interposed therein. When the core material 8 is interposed in the roof-shaped projection 6, the employment of a polyurethane elastomer foamed material allows the vibration of the ski generated in sliding to be absorbed and relieved by the core material 8; hence, the damping of the vibration can be facilitated to make the ski easier to maneuver. It is to be noted also that as the core material 8 it is possible to select any desired proper material, such as a foamed synthetic resin, wood and the like. On the other hand, as the upper-surface member 4, it is preferable to employ a material which is excellent in abrasion resistance, such as a synthetic resin, e.g., ABS, nylon and polyacetal, or a light alloy, since the upper-surface member 4 is subjected to abrasion in finishing the ski.

Figure 4:
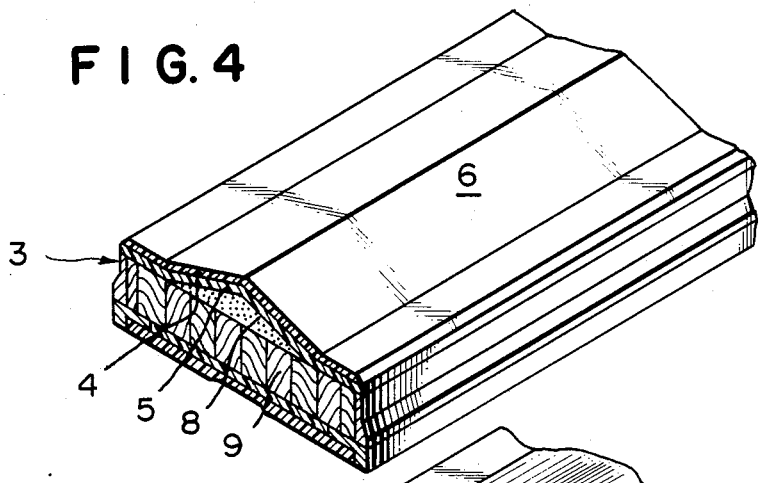
FIG. 4 is a sectional perspective view of an essential part of the ski in accordance with the invention.
Figure 5:
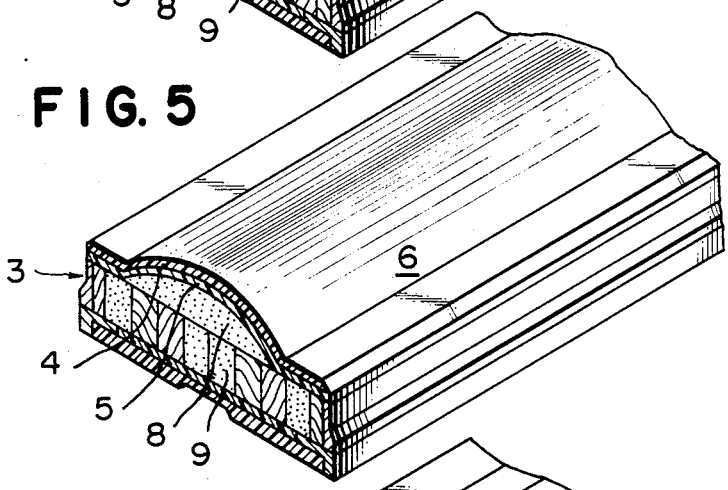
FIGS. 5 and 6 are sectional perspective views of essential parts of other embodiments of the ski in accordance with the invention, respectively.
Figure 6:
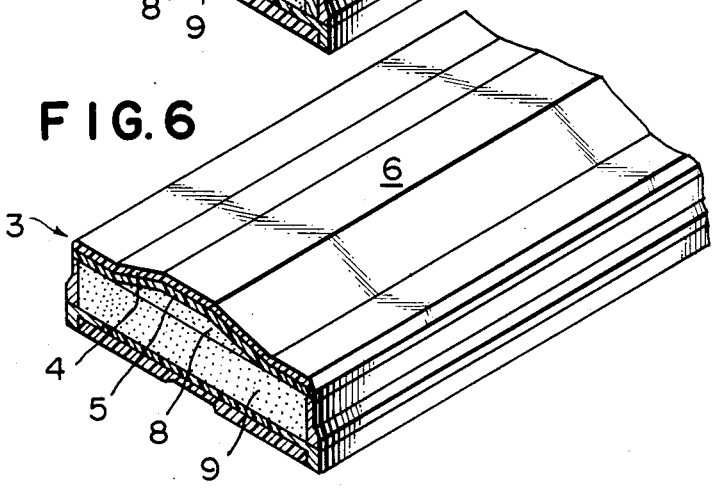

It is to be noted that the roof-shaped projection 6 may be formed, in cross-section, into an arched shape as shown in FIG. 5 or a trapezoidal shape as shown in FIG. 6 in addition to the angular shape as shown in Fig. 4. The existence of the roof-shaped projection 6 having the arched or trapezoidal cross-section makes the air flow along the roof-shaped projection 6 during sliding. In consequence, the ski is improved in directivity and at the same time, the front end portion of the ski is advantageously prevented from being lifted up, so that the sliding speed and the meneuverbility are further improved. In particular, if a synthetic resin having a high surface tension, such as polyethylene or fluoroplastic, is employed for the upper-surface member 4 constituting the upper-surface constituting member 7 provided with the roof-shaped projection 6 having the arched cross-section as shown in FIG. 5, then it is possible to provide a ski made effective in prevention of the adhesion of snow through an increase in surface tension. Thus, according to the invention, it is possible to provide a ski which permits an easy adjustment of such properties as torsional strength, flexural strength and flexural rigidity and therefore has performance best suited for each class of skier, from the beginner class to the intermediate and advanced classes as well as the champion class.

What we claim is:

1. A ski comprising:

an upper-surface constituting member positioned on an upper part of said ski provided with integral, elongated, longitudinally spaced, projections forward of and rearward of a ski binding mounting region and constituted by an upper surface member, and a reinforcing member underlying and in contact with said upper surface member, each of said projections terminating at a point spaced inwardly from a respective end and side edges of said ski and extending upwardly from said upper surface constituting member and having the shape of a roof whose ridge is defined by the widthwise central portion of said ski and that slopes downwardly and outwardly from a longitudinal center line of said ski and extends across a majority of the width of the ski so that the ski is flexible as a whole and front and rear parts of the ski are high in torsional strength and flexural strength.

2. A ski comprising:

a ski body having a ski binding mounting region between forward and rearward ends of said ski;

an upper-surface defining member positioned on an upper part of said ski body and having integral, elongated, longitudinally spaced upwardly extending projections in front of and at the rear of said ski binding mounting region, respectively, and a reinforcing member underlying and conforming in shape to said upper-surface defining member, each of said projections terminating at outer points spaced inwardly from a respective end and side edges of said ski and having the shape of a roof whose ridge is defined by the widthwise central portion of said ski and that slopes downwardly and outwardly from a longitudinal center line of said ski and extends across a majority of the width of the ski so that the ski is flexible as a whole and said forward and rearward ends of the ski are high in torsional strength and flexural strength.

3. A ski according to claim 2 wherein said projections terminate at inner points spaced from said ski binding portion.

4. A ski according to claim 3 wherein said projections define a cross section that has a maximum thickness between respective ends of said ski and said binding mounting region and along a longitudinal center line of said ski body and that has a minimum thickness adjacent outer side edges of the ski body.

5. A ski according to claim 4 wherein said upper-surface defining member includes laterally extending flat surfaces along the outmost side edges of the ski body.

6. A ski according to claim 2 wherein said projections are defined by planar surfaces that slope downwardly and outwardly from said ridge.

7. A ski according to claim 2 wherein said projections are defined by a curved arch.

8. A ski according to claim 2 wherein said projections have a trapezoidal cross section.

* * * * *